US007721355B2

(12) United States Patent
Jin

(10) Patent No.: US 7,721,355 B2
(45) Date of Patent: May 25, 2010

(54) MEN'S UNDERPANTS

(76) Inventor: Seong Bok Jin, 2FL. OH-BOK, 950, Hawangsimni 2-dong, Seongdong-gu, Seoul, 133-857 (KR)

( * ) Notice: Subject to any disclaimer, the term of this patent is extended or adjusted under 35 U.S.C. 154(b) by 0 days.

(21) Appl. No.: 12/108,445

(22) Filed: Apr. 23, 2008

(65) Prior Publication Data

US 2008/0189833 A1 Aug. 14, 2008

Related U.S. Application Data

(63) Continuation of application No. PCT/KR2007/004417, filed on Sep. 13, 2007.

(30) Foreign Application Priority Data

Sep. 21, 2006 (KR) ..... 10-2006-0091690
Jul. 12, 2007 (KR) ..... 10-2007-0070302

(51) Int. Cl.
*A41B 9/02* (2006.01)
*A41B 9/00* (2006.01)

(52) U.S. Cl. ..... 2/403; 2/400

(58) Field of Classification Search ..... 2/400–405; 602/67–72; 604/385.2, 369, 374, 327, 346, 604/347, 349, 355, 356, 366, 381–387, 394–396
See application file for complete search history.

(56) References Cited

U.S. PATENT DOCUMENTS 4,414,971 A * 11/1983 Chung ..... 602/67
5,226,179 A * 7/1993 Choi ..... 2/403
5,275,592 A * 1/1994 Grizzaffi ..... 604/396
5,556,393 A * 9/1996 Ronnberg ..... 604/385.26
6,038,703 A * 3/2000 Chung ..... 2/403
6,125,476 A * 10/2000 Jerome ..... 2/403
7,412,731 B1 * 8/2008 Brassill ..... 2/456

FOREIGN PATENT DOCUMENTS

| | | |
|---|---|---|
| JP | 08-049102 A | 2/1996 |
| KR | 20-0212085 Y1 | 2/2001 |
| KR | 20-0379226 Y1 | 3/2005 |
| KR | 20-0389533 Y1 | 7/2005 |

OTHER PUBLICATIONS

International Search Report (for PCT/KR2007/004417), WIPO, Dec. 24, 2007.

* cited by examiner

*Primary Examiner*—Gloria Hale
(74) *Attorney, Agent, or Firm*—Park & Associates IP Law LLC

(57) ABSTRACT

A man's underpants having a penis of the wearer received in an arc-shaped groove of the soft penis separator so as to separate the penis and scrotum from each other, thereby preventing the contacting portion between the penis and scrotum from humidity and odor and also preventing the penis from being moved or inserted between the flesh inside of the thigh during exercising or sitting for long time.

9 Claims, 11 Drawing Sheets

MEN'S UNDERPANTS

REFERENCE TO RELATED APPLICATIONS

This is a continuation of pending International Patent Application PCT/KR2007/004417 filed on Sep. 13, 2007, which designates the United States and claims priority of Korean Patent Applications No. 10-2006-0091690 filed on Sep. 21, 2006 and No. 10-2007-0070302 filed Jul. 12, 2007, the entire contents of which are incorporated herein by reference.

FIELD OF THE INVENTION

The present invention relates to a man's underpants in that a soft penis separator is attached to an inside of the front of an underpants body, so that the penis and the scrotum of the wearer are separated from each other, whereby preventing the contacting portion between the penis and scrotum from being humidified. The present invention relates more particularly to a soft penis separator having an arc-shaped groove for inserting and enclosing a penis of a wearer, integrally formed at the inside of the front of the man's underpants between a lining and a surface thereof by means of sewing. A plurality of vent holes is formed at the soft penis separator, and both end portions of the soft penis separator is fixed through sewing, so that the penis of the wearer can be easily received in the soft penis separator so as to separate the penis and scrotum from each other, whereby preventing the contacting portion between the penis and scrotum from humidity and odor. The penis of the wearer is received in the soft penis separator at all times, so that it can prevent the penis from being drooped, moved or inserted between the flesh inside of the thigh during exercising or sitting for many hours. A mesh is fixed to front and rear surfaces of the soft penis separator having a plurality of vent holes and a protective edging is fixed to a circumference thereof, so that it can ventilate the inside of the soft penis separator and prevent damage of the circumference part of the soft penis separator.

BACKGROUND OF THE INVENTION

Generally, in case of a man's underpants, when the wearer exercises or has been sitting down for many hours, the penis of the wearer moves, so that it can rub with the flesh inside of the thigh or adhere to the scrotum, thereby being humidified and having a bad blood circulation.

Recently, in order to improve the problem, Korean Utility model registration No. 20-0248 175 discloses a man's underpants in that a pocket cloth having a penis outlet for inserting the penis upward is formed inside the underpants by means of sewing and a compressing band formed at the pocket cloth transversely. The penis and the scrotum of the wearer are separated from each other by the compressing band during wearing thereof, thereby the penis of the wearer can face the lower abdomen of the wearer.

As shown in FIG. 1 and FIG. 2, the conventional man's underpants include a penis outlet 2 for exposing the penis of the wearer outside formed at the front of the underpants 1 transversely, upper and lower pockets 3*a* and 3*b* for dividing the exposing area of the penis into upper or lower portion fixed to the front of the penis outlet 2 by sewing, gaps 4 for taking out the penis from the underpants 1 formed at both sides of the pocket cloths 3 cross the penis outlet 2, and a compressing band 5 for supporting the boundary area between the penis and the scrotum formed at the pocket cloth transversely in front of the penis outlet 2 and the gaps 4.

Accordingly, the penis and the scrotum of the wearer are separated from the inside of the underpants 1 and the penis of the wearer faces the lower abdomen of the wearer in an erected state. Also, the penis and the scrotum of the wearer are separated from each other through the compressing band 5, so that it can prevent the penis from being leaned toward the flesh inside of the thigh.

However, when the pocket cloth 3 is formed at the inside of the underpants 1 through sewing such that the penis faces the lower abdomen of the wearer in an erected state, since the separated upper and lower pockets 3*a* and 3*b* and compressing band 5 should be formed at the pocket cloth 3, it is difficult to make the underpants 1. Also, it is troublesome in that the penis should be put in the pocket upwards using the hand of the wearer.

Also, since the pocket cloth 3 is located at the inside of the underpants 1 in the form of a lining, the scrotum of the wearer should be inserted into the pocket cloth while widening it with the hand of the wearer. Moreover, the compressing band 5 formed at the pocket cloth transversely can compress the penis and scrotum of the wearer. Accordingly, there is a problem in that it is very hard to wear it.

SUMMARY OF THE INVENTION

It is, therefore, an object of the present invention to provide a man's underpants in that a soft penis separator is attached to an inside of the front of an underpants body through sewing or other methods, so that the penis of the wearer can be naturally received in an arc-shaped groove of the soft penis separator during wearing thereof so as to separate the penis and scrotum from each other, thereby preventing the contacting portion between the penis and scrotum from being humidified and smelling bad and also preventing the penis from being moved or inserted between the flesh inside of the thigh during exercising or sitting for many hours. The soft penis separator is provided with a plurality of vent holes, so that it can smoothly ventilate the inside of the soft penis separator, thereby keeping clean at all times.

Another object of the present invention is to provide a man's underpants in that the soft penis separator is further provided with a supporting part for supporting the penis of the wearer received in the penis separator formed transversely along a middle portion of the arc-shaped groove fixed to the lining thereof, so that the penis of the wearer is received in the soft penis separator at all times, thereby preventing the penis from being drooped or separated from the penis separator and preventing the penis from being moved or inserted between the flesh inside of the thigh during exercising or sitting for many hours. A mesh is fixed to front and rear surfaces of the soft penis separator having a plurality of vent holes and a protective edging is fixed to a circumference thereof, so that it can smoothly ventilate the inside of the soft penis separator and prevent damage of the circumference part of the soft penis separator.

To achieve the above objects of the present invention, provided is a man's underpants comprising: a soft penis separator attached to an inside of a front of an underpants body by means of sewing; an arc-shaped groove for inserting and enclosing a penis therein and formed inside the underpants body; two side portions for fixing into the underpants body formed at both sides of the arc-shaped groove; and opening portions formed at upper and lower portions of the soft penis separator so as to induce trace of the penis during wearing thereof.

Preferably, extending portions extend to upper portions of each side portions so as to be fixed integrally to an upper band portion of the underpants body through sewing and a plurality of vent holes are formed at a circumference surface of the arc-shaped groove of the soft penis separator, thereby keeping clean at all times.

To achieve the above objects of the present invention, there is provided another man's underpants comprising: a soft penis separator integrally attached to an inside of the front of the man's underpants between a lining and a surface thereof by means of sewing; an arc-shaped groove for inserting and enclosing a penis therein and formed in a lengthwise direction; a lower opening portion for inducing a trace of the penis during wearing thereof and formed at a lower portion of the arc-shaped groove; a plurality of vent holes formed at the soft penis separator; a mesh fixed to front and rear surfaces of the soft penis separator; and a protective edging for preventing damage to the soft penis separator fixed to a circumference of the soft penis separator through sewing.

Preferably, a protective edging for preventing a damage of the soft penis separator is fixed to a circumference of the soft penis separator having the mesh therein.

Preferably, an elastic supporting part for supporting the penis of the wearer received in the penis separator is formed transversely along a middle portion of the arc-shaped groove fixed to the lining and has both end portions thereof fixed through sewing.

Preferably, an upper opening portion along with the lower opening portion is formed at an upper portion of the arc type groove for receiving the penis in the soft penis separator formed in a lengthwise direction.

As described above, in the man's underpants, the penis of the wearer can be naturally received in an arc type groove of the soft penis separator during wearing thereof so as to separate the penis and scrotum from each other, thereby preventing the contacting portion between the penis and scrotum from humidity and bad odor, and also preventing the penis from being moved or inserted between the flesh inside of the thigh during exercising or sitting for many hours. The soft penis separator is provided with the plurality of vent holes, so that it can effectively ventilate the inside of the soft penis separator, thereby keeping clean at all times.

Also, the soft penis separator is further provided with the supporting part for supporting the penis of the wearer received in the penis separator formed transversely along a middle portion of the arc type groove fixed to the lining thereof, so that the penis of the wearer is received in the soft penis separator at all times. It can thereby prevent the penis from being drooped or separated from the penis separator and prevent the penis from being moved or inserted between the flesh inside of the thigh during exercising or sitting for many hours. A mesh is fixed to front and rear surfaces of the soft penis separator having a plurality of vent holes and a protective edging is fixed to a circumference thereof, so that it can effectively ventilate the inside of the soft penis separator and prevent damage of the circumference part of the soft penis separator.

DETAILED DESCRIPTION OF THE INVENTION

A preferred embodiment of the invention will be described in detail below.

Figure 1:
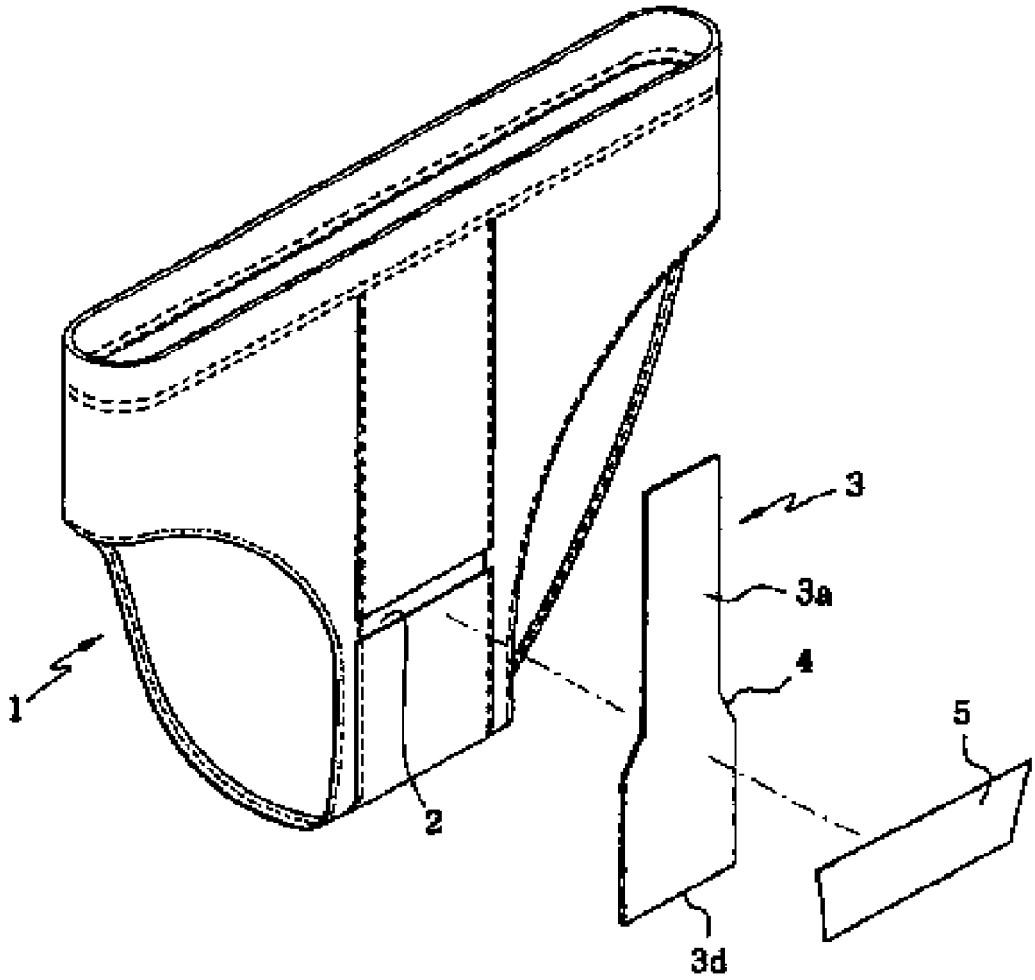
FIG. 1 (PRIOR ART)
FIG. 1 is an exploded perspective view illustrating a conventional a man's underpants.
Figure 2:
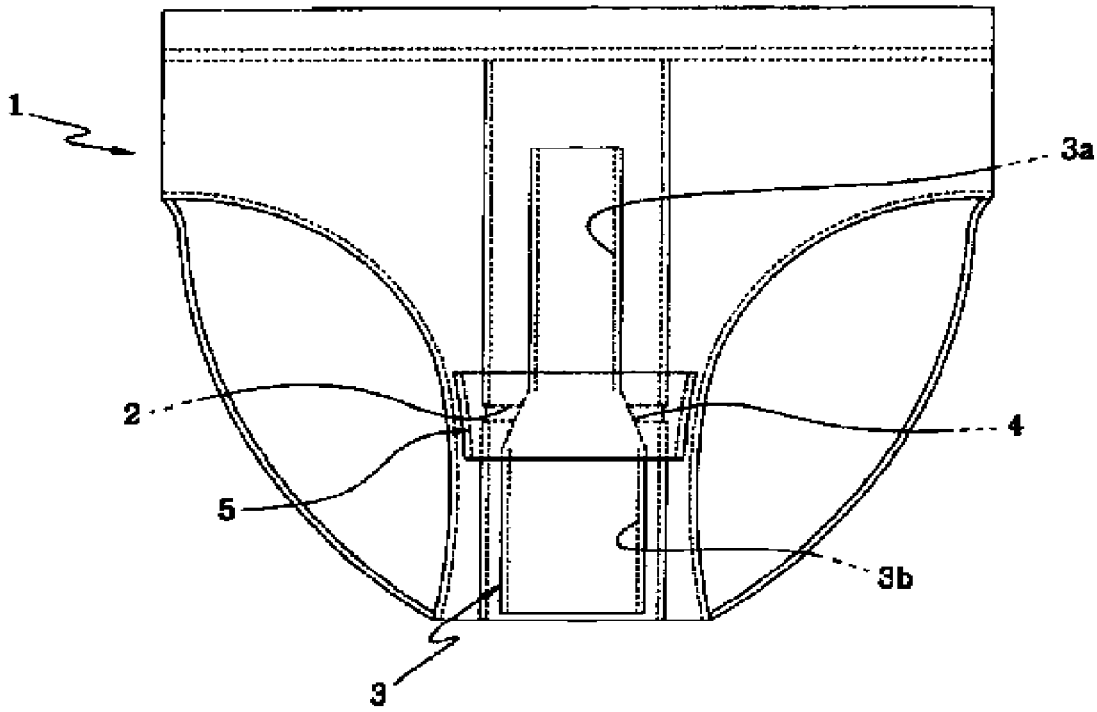
FIG. 2 (PRIOR ART)
FIG. 2 is a front view of FIG. 1.
Figure 3:
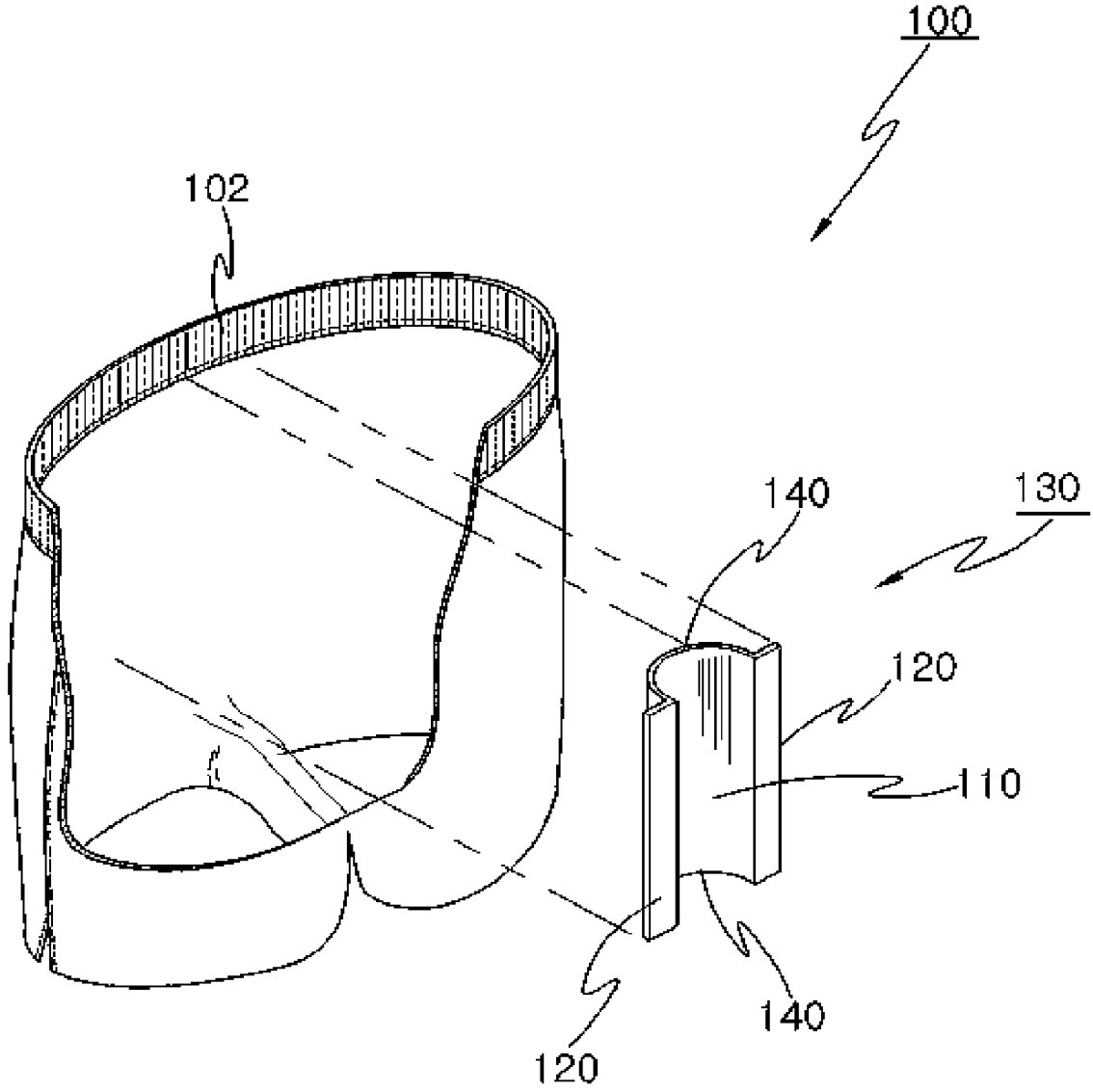
FIG. 3 is a schematically exploded perspective view illustrating a man's underpants according to one embodiment of the present invention.
Figure 4:
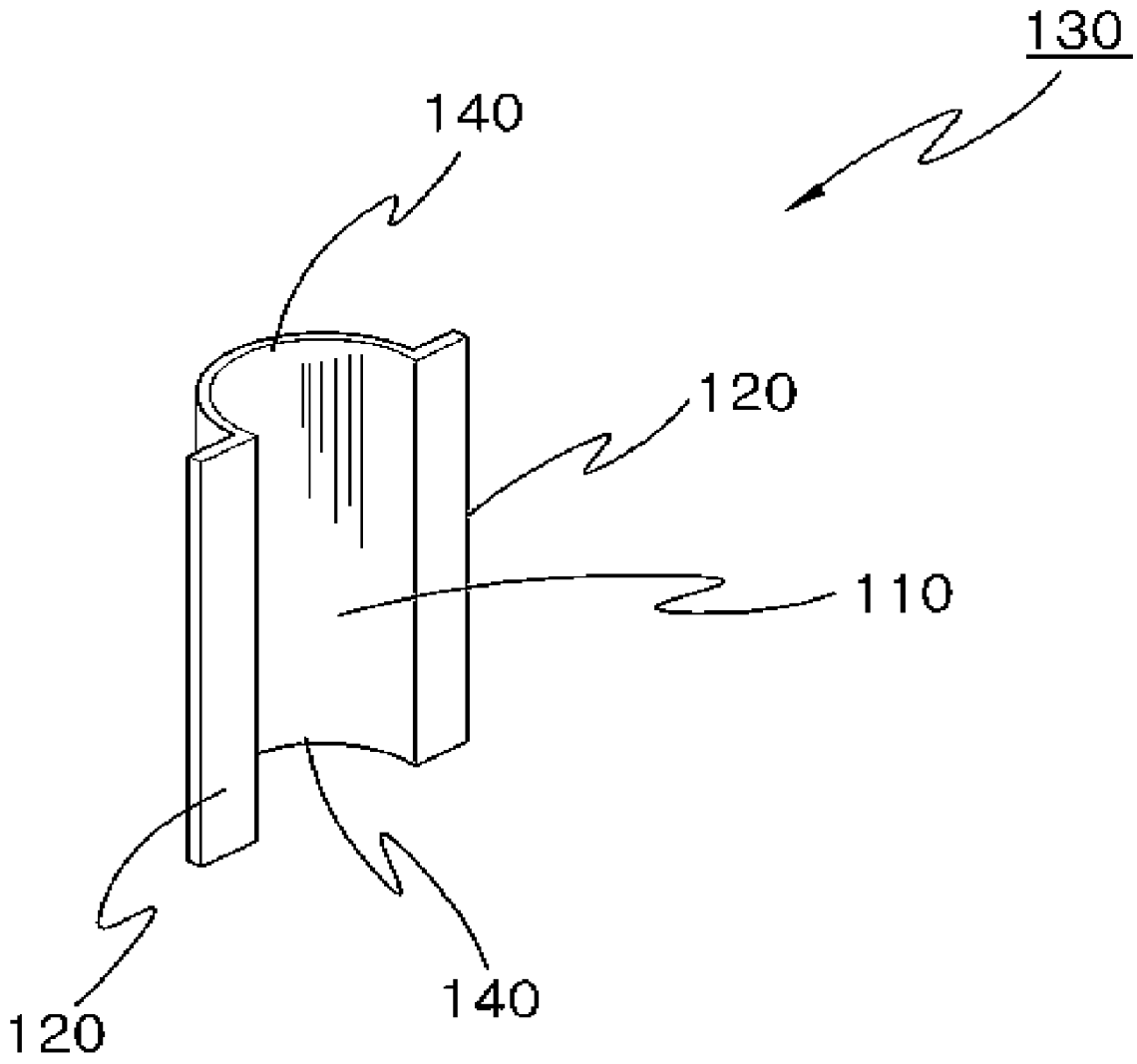
FIG. 4 is a schematically perspective view illustrating a penis separator formed inside a man's underpants according to one embodiment of the present invention.

FIG. 3 is a schematically exploded perspective view illustrating a man's underpants according to one embodiment of the present invention and FIG. 4 is a schematically perspective view illustrating a penis separator formed inside a man's underpants according to one embodiment of the present invention.

As shown in FIG. 3 and FIG. 4, the man's underpants 100 according to the present invention includes a soft penis separator 130 attached to an inside of the front of an underpants body by means of sewing or other methods. The soft penis separator 130 is formed of a flexible material and shaped typically into a thin member of substantially uniform thickness, as shown in FIGS. 3 and 4, and includes an arc type groove 110 for inserting and enclosing a penis therein, which is formed inside the underpants body, and two side portions 120 for fixing with the underpants body and formed at both sides of the arc type groove 110.

Also, the soft penis separator 130 further includes opening portions 140 formed at upper and lower portions thereof so as to induce a trace of the penis during wearing. Moreover, as shown in FIG. 5, the soft penis separator 130 further includes extending portions 150 extending to the upper portions of each side portions 120 so as to be fixed integrally to an upper band portion 102 of the underpants body through sewing.

The operation and effect of the man's underpants according to The present invention described above will be described in detail below.

Figure 5:
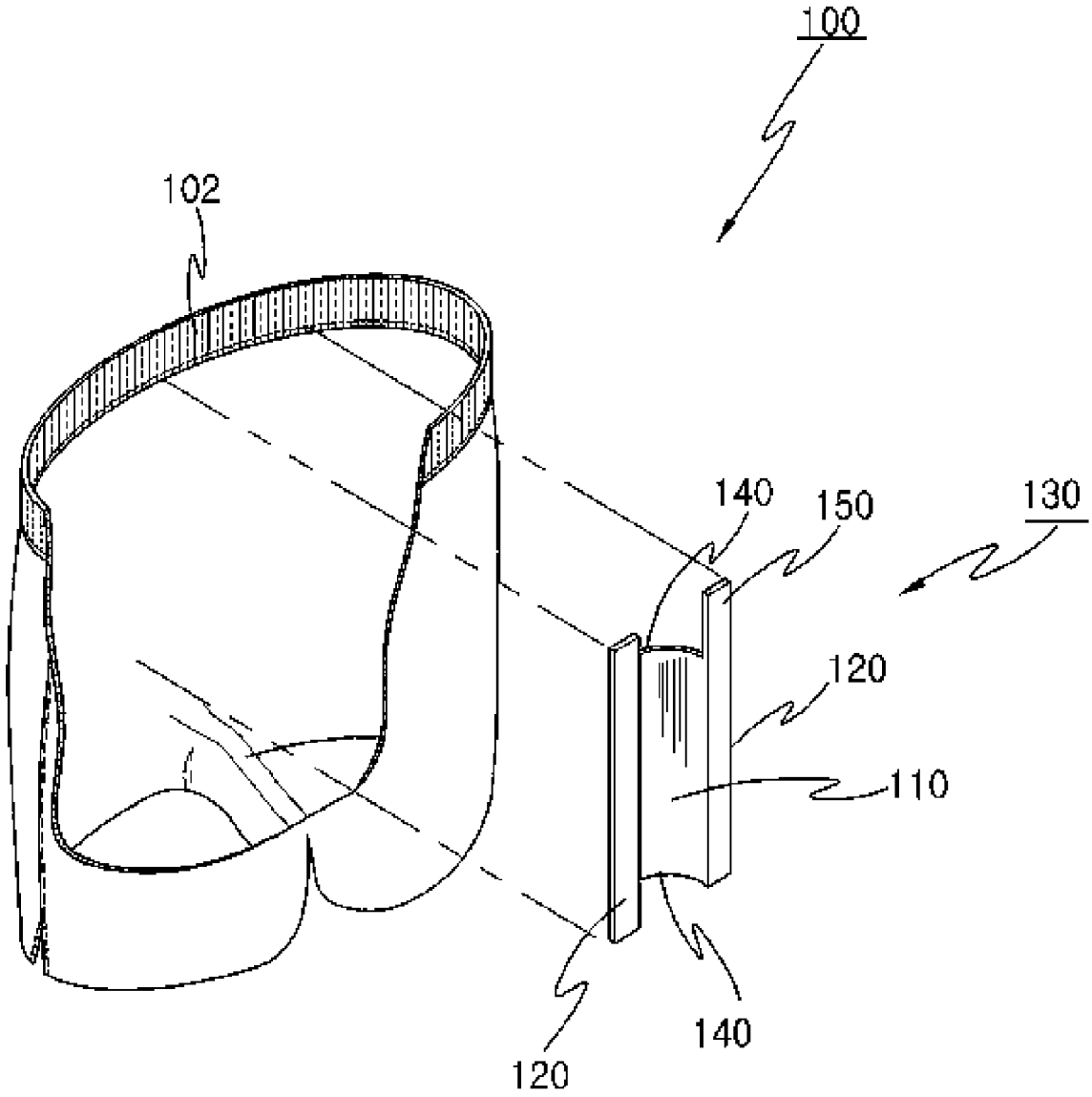
FIG. 5 is a schematic perspective view illustrating extending portions for combining a band of the underpants with the penis separator formed inside a man's underpants according to one embodiment of the present invention.

As shown in FIG. 3 through FIG. 5, the soft penis separator 130 is formed at the inside of the front of the underpants 100 by means of sewing, so that the penis of the wearer can be easily received in and separated by the soft penis separator 130 through means of a simple wearing operation thereof.

Also, the soft penis separator 130 is provided with an arc-shaped groove 110 for inserting and enclosing the penis of the wearer therein, so that the penis of the wearer can be naturally received in the arc-shaped groove 110 of the soft penis separator 130 during wearing of the underpants 100. Here, two side portions 120 are formed at both sides of the arc-shaped groove 110, so that the soft penis separator 130 can be attached to the inside of the front of the underpants body by means of sewing or other methods.

The soft penis separator 130 can also be fixed to the inside of the underpants 100 by means of a button or a magic fastener and so on, besides the sewing method described above.

Also, the soft penis separator 130 is provided with the opening portions 140 formed at upper and lower portions thereof so as to induce a trace of the penis during wearing, so that the penis and scrotum of the wearer are automatically separated through the opening portions 140 and only the penis is received inside of the arc-shaped groove 110.

Moreover, as shown in FIG. 5, the soft penis separator 130 is provided with the extending portions 150 extending to the upper portions of each side portion 120, so that it can be fixed integrally to an upper band portion 102 of the underpants body through sewing.

The soft penis separator 130 is made of urethane, a silicon, a sponge and other various materials, thereby having an excellent fit and naturally enclosing and protecting the penis of the wearer.

Figure 6:
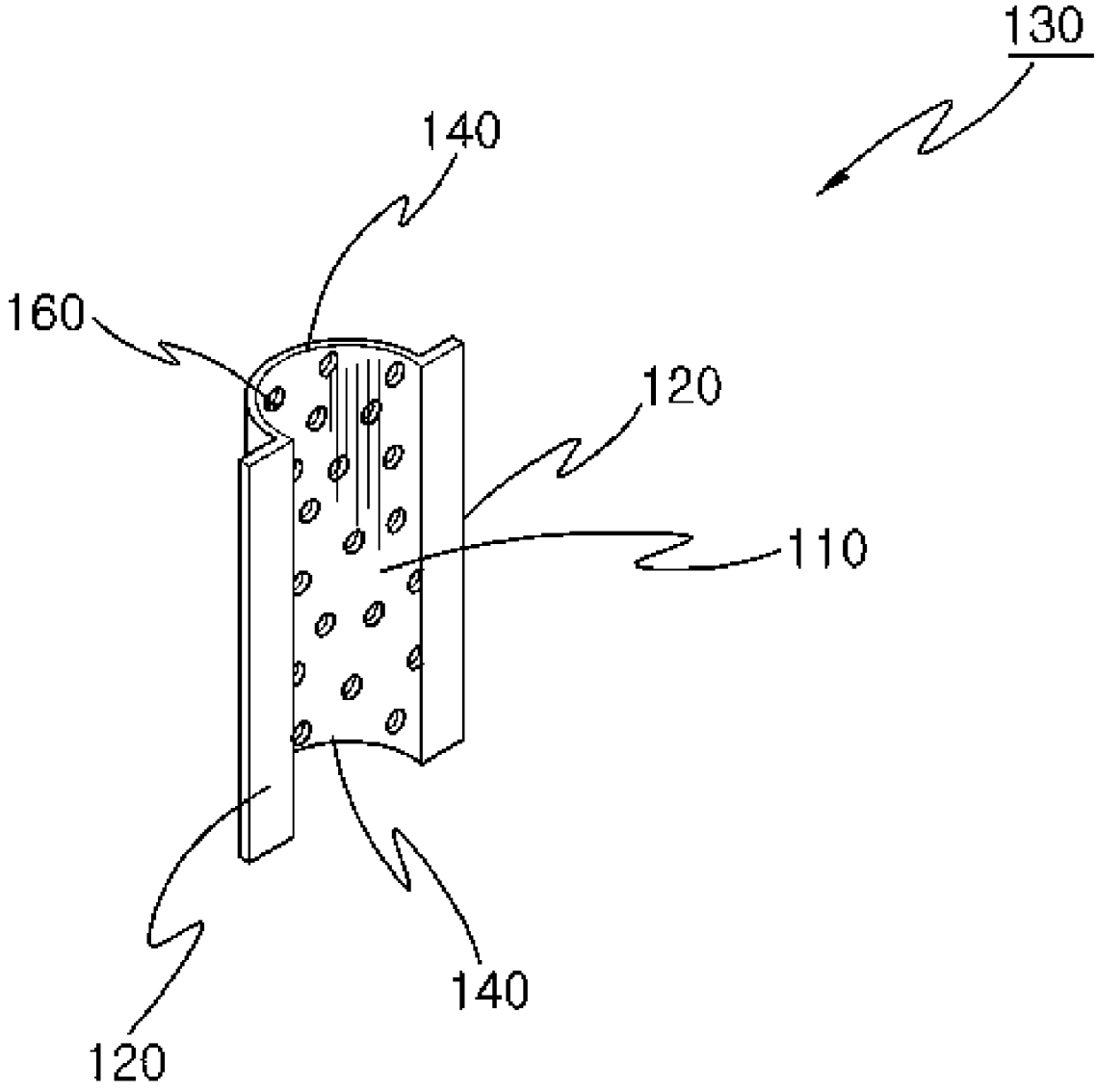
FIG. 6 is a schematically perspective view illustrating a penis separator formed inside a man's underpants according to a second embodiment of the present invention.

FIG. 6 is a schematically perspective view illustrating a penis separator formed inside a man's underpants according to a second embodiment of the present invention.

As shown in FIG. 6, the soft penis separator 130 is further provided with a plurality of vent holes 160 formed at a circumference surface of the arc-shaped groove 110, so that it can smoothly ventilate the inside of the soft penis separator 130, thereby keeping it clean at all times.

Figure 7:
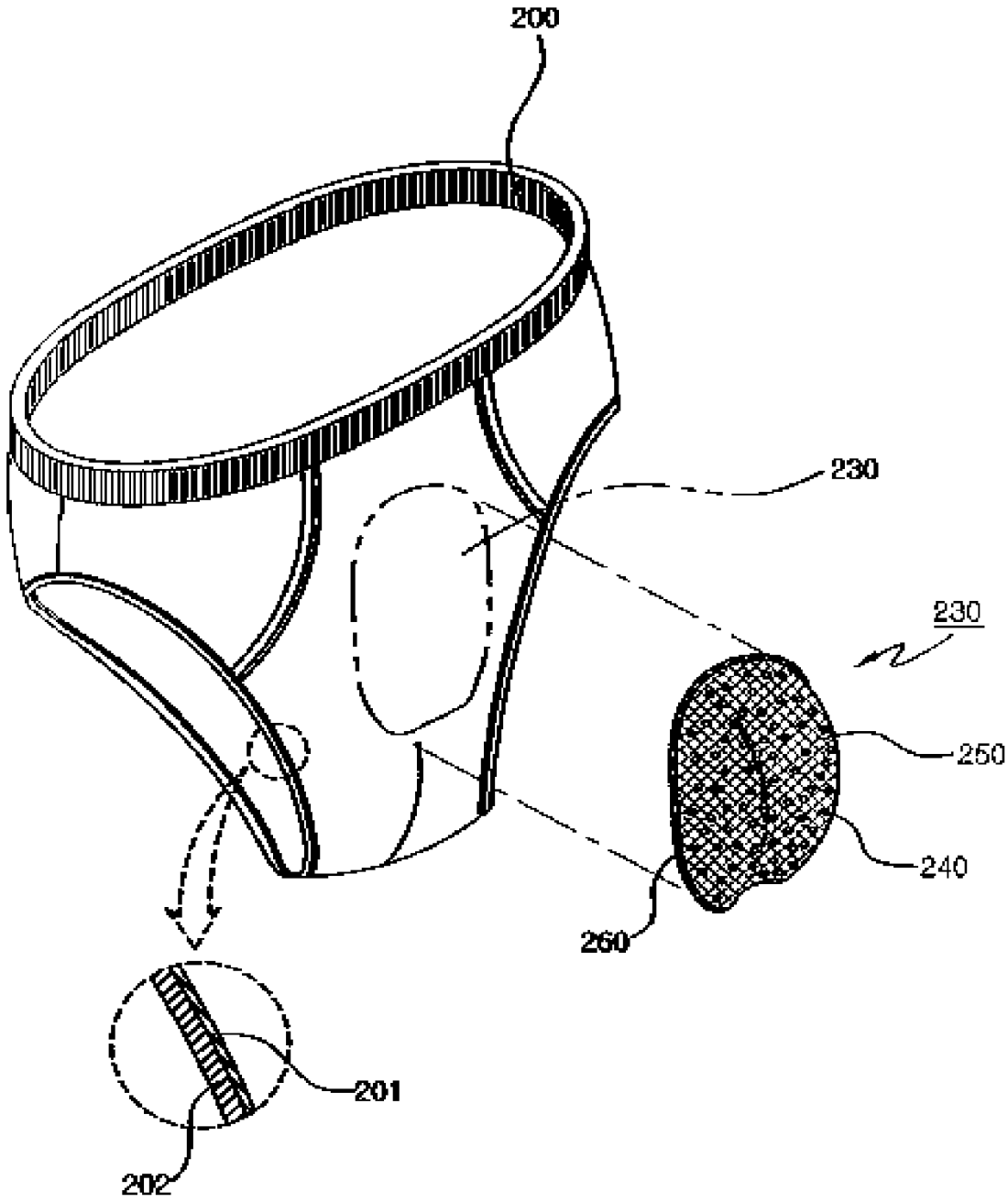
FIG. 7 is a schematically exploded perspective view illustrating a man's underpants according to a third embodiment of the present invention.
Figure 8:
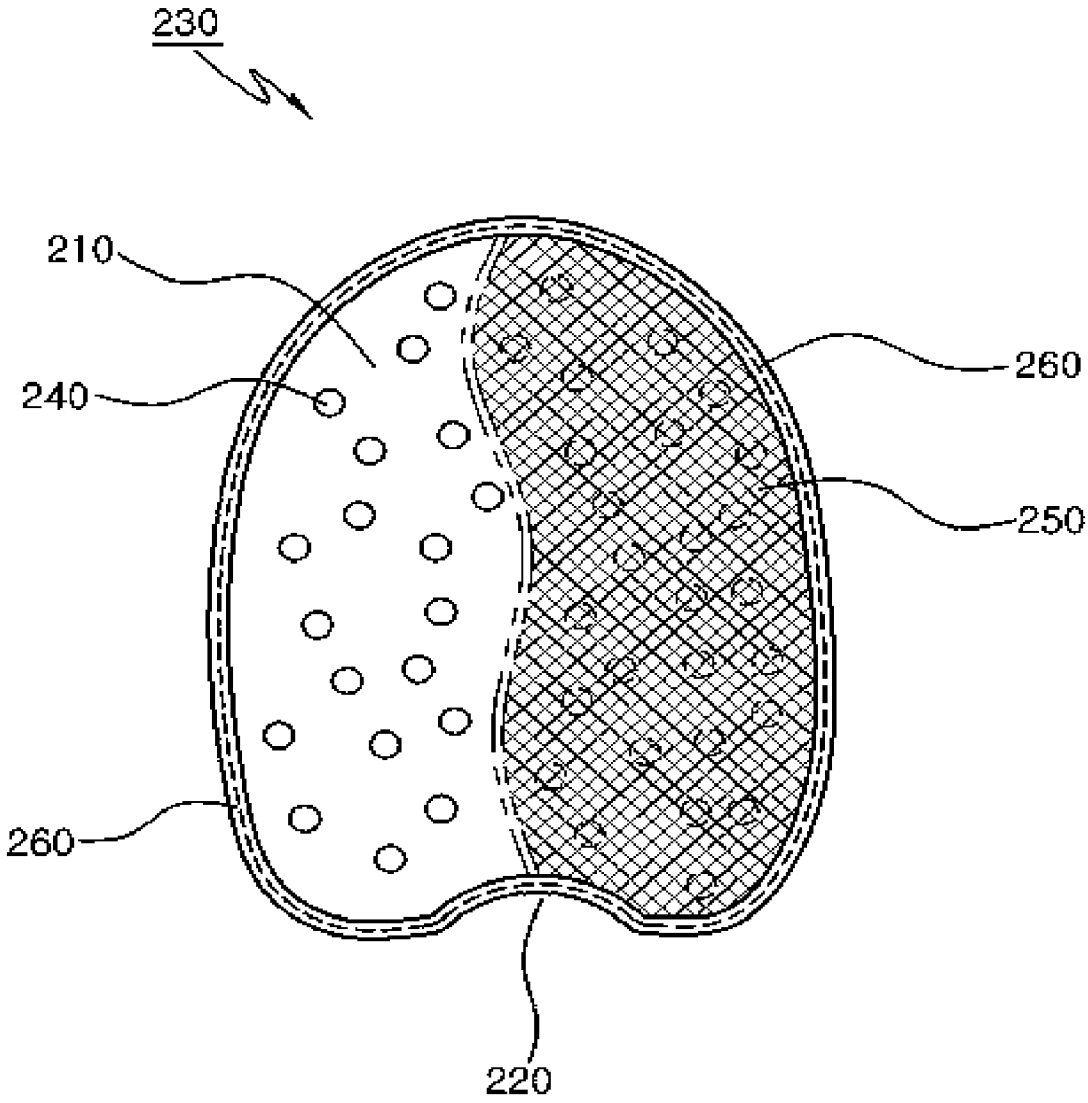
FIG. 8 is a partially and schematically perspective view illustrating a penis separator formed at an inside of a center of a man's underpants between a lining and a surface thereof according to a third embodiment of the present invention.
Figure 9:
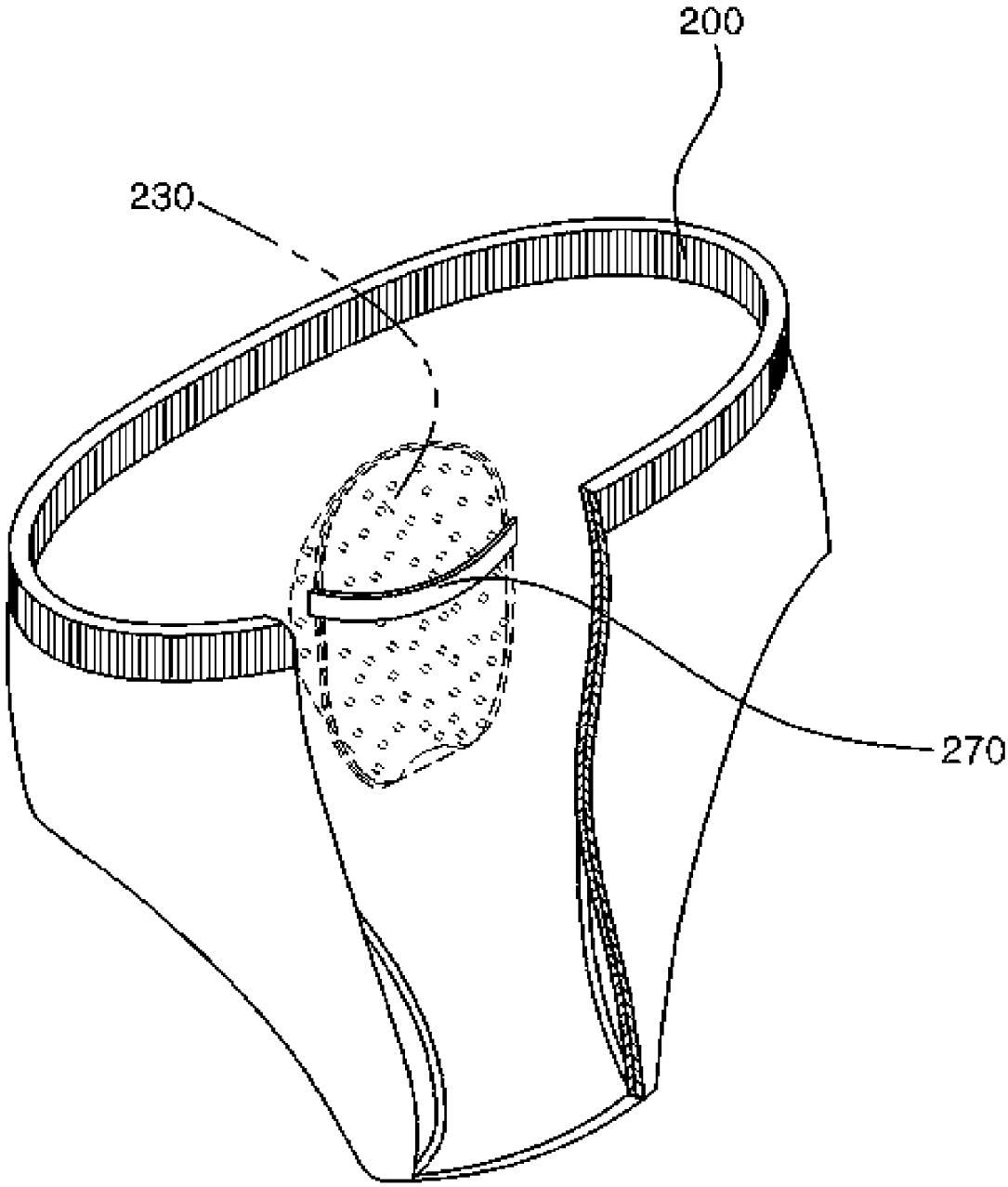
FIG. 9 is a front perspective view illustrating a status of a supporting part formed at the penis separator of FIG. 7.
Figure 10:
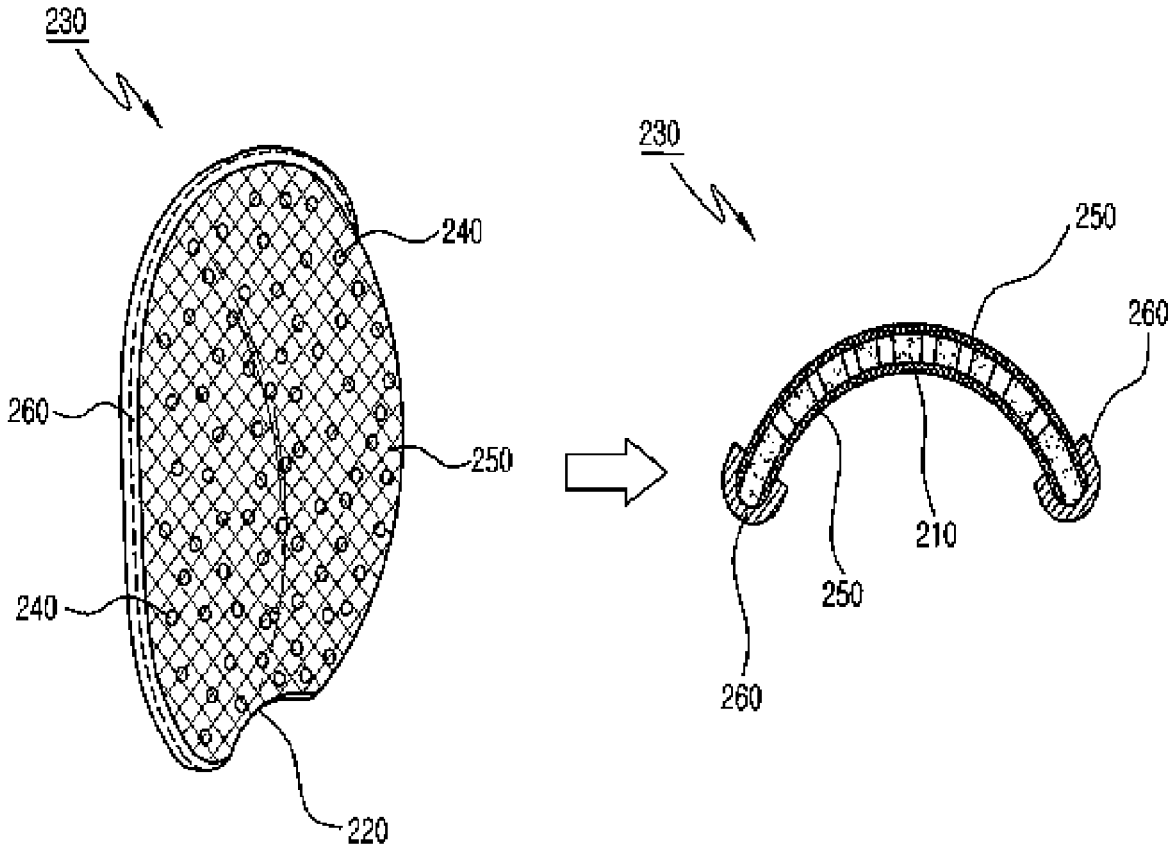
FIG. 10 is a schematically perspective view illustrating the penis separator of FIG. 7.

FIG. 7 is a schematically exploded perspective view illustrating a man's underpants according to a third embodiment of the present invention. FIG 8 is a partially and schematically perspective view illustrating a penis separator formed at the inside of a center of the underpants between a lining and a surface thereof according to a third embodiment of the present invention. FIG. 9 is a front perspective view illustrating a status of a supporting part formed at the penis separator of FIG. 7, and FIG. 10 is a schematically perspective view illustrating the penis separator of FIG. 7.

As shown in the drawings, the man's underpants 200 according to the third embodiment of the present invention includes a soft penis separator 230 integrally attached to an inside of the front of a man's underpants between a lining 202 and a surface 201 thereof by means of sewing or other methods. The soft penis separator 230 includes an arc-shaped groove 210 for inserting and enclosing a penis therein formed in a lengthwise direction and an opening portion 220 for inducing a trace of the penis during wearing thereof formed at a lower portion of the arc-shaped groove 210.

Also, the soft penis separator 230 further includes a plurality of vent holes 240 formed at a circumference surface of the arc-shaped groove 210, a mesh 250 fixed to front and rear surfaces thereof, and a protective edging 260 for preventing the damage of the soft penis separator 230 fixed to a circumference thereof through sewing.

Also, the soft penis separator 230 further includes an elastic supporting part 270 for supporting the penis of the wearer received in the penis separator 230 formed transversely along a middle portion of the arc-shaped groove 210 fixed to the lining 202 and having both end portions thereof fixed through sewing.

Accordingly, as shown in FIG. 7 through FIG. 10, the soft penis separator 230 includes the arc-shaped groove 210 formed at the inside of the front of underpants 200 between the lining 202 and the surface 201 and the opening portion 220 formed at the lower portion of the arc-shaped groove 210, so that the penis of the wearer can be easily received in and separated from the soft penis separator 230 through the opening portion 220 by means of a simple wearing operation thereof.

Especially, the soft penis separator 230 is further provided with a plurality of vent holes 240 formed at the circumference surface of the arc-shaped groove 210 and a mesh 250 fixed to the front and rear surfaces thereof, so that it can smoothly ventilate the inside of the soft penis separator 230 and prevent the contacting portion between the penis and scrotum from being humidified.

Also, the soft penis separator 230 made of urethane, silicon, sponge and various other materials is further provided with a protective edging 260 fixed to the circumference thereof through sewing, so that it can prevent damage of the soft penis separator 230.

Moreover, the soft penis separator 230 is further provided with the supporting part 270 formed transversely along the middle portion of the arc-shaped groove 210 fixed to the lining 202 and having both end portions thereof fixed through sewing, so that the supporting part 270 of a belt type can support the penis of the wearer received in the penis separator 230, thereby preventing the penis from being drooped or separated from the penis separator 230. Also, it can prevent the penis from being moved or inserted between the flesh inside of the thigh during exercising or sitting for many hours.

Figure 11:
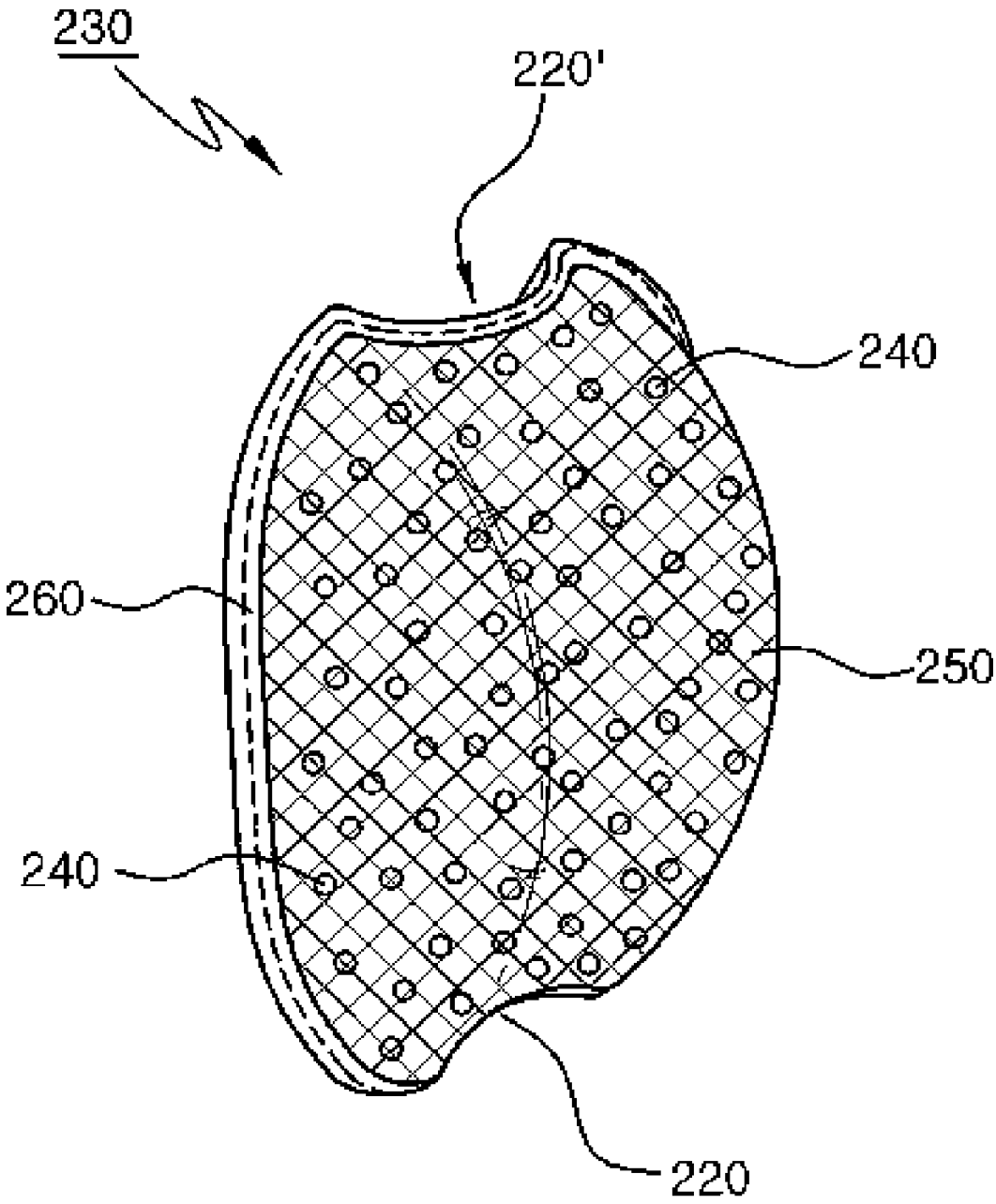
FIG. 11 is a schematically perspective view illustrating a penis separator formed inside a man's underpants according to a fourth embodiment of the present invention.

FIG. 11 is a schematically perspective view illustrating a penis separator formed inside a man's underpants according to a fourth embodiment of the present invention.

As shown in FIG. 11, the soft penis separator 230 is further provided with an upper opening portion 220' as well as the lower opening portion 220 formed at upper and lower portions of the arc-shaped groove 210 for easily receiving the penis in the soft penis separator 230 formed in a lengthwise direction, so that it can smoothly ventilate the inside of the arc-shaped groove 210 through the upper and lower opening portions 220' and 220 and prevent the contacting portion between the penis and scrotum from being humidified.

INDUSTRIAL APPLICABILITY

The present invention relates to a man's underpants in that a soft penis separator is attached to an inside of the front of an underpants body, so that the penis and the scrotum of the wearer are separated from each other, whereby preventing the contacting portion between the penis and scrotum from being humidified.

While this invention has been described in connection with what are presently considered to be the most practical and preferred embodiments, it is to be understood that the invention is not limited to the disclosed embodiments and the drawings, but, on the contrary, is intended to cover various modifications and variations within the spirit and scope of the appended claims.

What is claimed is:

1. A man's undergarment comprising:

an underpants body, the underpants body including a front having an inside and an outside;

a soft penis separator attached to the inside of the underpants body front;

said soft penis separator formed of a flexible or soft material and shaped into a thin member with substantially uniform thickness, the soft penis separator including an arc-shaped groove for receiving a penis therein;

said soft penis separator including two side portions at both sides of the arc-shaped groove, the soft penis separator attached to the inside of the underpants body front by sewing at the two side portions; and opening portions formed at upper and lower portions of the soft penis separator for introducing a penis through the opening portions;

wherein the two side portions of the soft penis separator include upper extending portions for fixing to an upper band portion of the underpants body by sewing.

2. A man's undergarment comprising:

an underpants body, the underpants body including a front having an inside and an outside;

a soft penis separator attached to the inside of the underpants body front;

said soft penis separator formed of a flexible or soft material and shaped into a thin member with substantially uniform thickness, the soft penis separator including an arc-shaped groove for receiving a penis therein;

said soft penis separator including two side portions at both sides of the arc-shaped groove, the soft penis separator attached to the inside of the underpants body front by sewing at the two side portions; and opening portions formed at upper and lower portions of the soft penis separator for introducing a penis through the opening portions;

wherein a material of the soft penis separator is selected from any one of urethane, silicon, and sponge.

3. A man's undergarment comprising:

an underpants body. the underpants body including a front having an inside and an outside;

a soft penis separator attached to the inside of the underpants body front;

said soft penis separator formed of a flexible or soft material and shaped into a thin member with substantially uniform thickness, the soft penis separator including an arc-shaped groove for receiving a penis therein;

said soft penis separator including two side portions at both sides of the arc-shaped groove, the soft penis separator attached to the inside of the underpants body front by sewing at the two side portions; and opening portions formed at upper and lower portions of the soft penis separator for introducing a penis through the opening portions;

wherein a plurality of vent holes are formed at a surface of the soft penis separator.

4. A man's undergarment comprising:

an underpants body, the underpants body including a front having an inside and an outside;

a soft penis separator attached to the inside of the front of the underpants body;

said soft penis separator including an arc-shaped groove for enclosing a penis therein;

said soft penis separator including a lower opening portion for introducing the penis through the lower opening portion and having a plurality of vent holes formed at a surface of the soft penis separator where the arc-shaped groove is formed; and a mesh layer fixed to front and rear surfaces of the soft penis separator.

5. A man's undergarment as claimed in claim 4, wherein said soft penis separator includes a protective edging fixed to a circumference of the soft penis separator.

6. A man's undergarment as claimed in claim 4, wherein an elastic supporting part for supporting the penis of the wearer received in the penis separator is formed transversely along a middle portion of the penis separator and fixed to a lining of the underpants body by sewing.

7. A man's undergarment as claimed in claim 4, wherein said soft penis separator includes an upper opening portion formed at an upper portion for receiving the penis in the soft penis separator.

8. A man's undergarment as claimed in claim 4, wherein said soft penis separator is attached to the underpants body by sewing between a lining of the underpants body and the outside of the front.

9. A man's undergarment comprising:

an underpants body, the underpants body including a front having an inside and an outside;

a soft penis separator attached to the inside of the front of the underpants body;

said soft penis separator including an arc-shaped groove for receiving a penis therein in a generally lengthwise direction;

said soft penis separator including an opening for introducing the penis through the opening;

said soft penis separator including a protective edging fixed to a circumferential area of the soft penis separator; and a mesh layer fixed to front and rear surfaces of the soft penis separator.

* * * * *